US007430995B2

(12) United States Patent
Christophersen

(10) Patent No.: US 7,430,995 B2
(45) Date of Patent: Oct. 7, 2008

(54) CONSTANT OPTIMUM TOTAL COMPRESSION: REAL-TIME MANIPULATION OF COMBUSTION CHAMBER VOLUME AS A MEANS OF OPTIMIZING COMPRESSION IN INTERNAL COMBUSTION ENGINES

(76) Inventor: Edward Arthur Christophersen, 1711 Huston St., Marysville, CA (US) 95901

( * ) Notice: Subject to any disclaimer, the term of this patent is extended or adjusted under 35 U.S.C. 154(b) by 163 days.

(21) Appl. No.: 11/286,519

(22) Filed: Nov. 26, 2005

(65) Prior Publication Data

US 2006/0118068 A1 Jun. 8, 2006

Related U.S. Application Data

(60) Provisional application No. 60/632,878, filed on Dec. 3, 2004.

(51) Int. Cl.
*F02B 75/04* (2006.01)

(52) U.S. Cl. ..... 123/48 AA; 123/48 R; 123/48 A

(58) Field of Classification Search ..... 123/48 AA, 123/48 R, 48 A
See application file for complete search history.

(56) References Cited

U.S. PATENT DOCUMENTS

| | | | | | |
|---|---|---|---|---|---|
| RE26,503 | E | * | 12/1968 | Race | 123/48 AA |
| 4,187,808 | A | * | 2/1980 | Audoux | 123/48 AA |
| 4,286,552 | A | * | 9/1981 | Tsutsumi | 123/48 AA |
| 4,516,537 | A | * | 5/1985 | Nakahara et al. | 123/48 AA |
| 5,007,384 | A | * | 4/1991 | Blair | 123/48 A |
| 5,063,883 | A | * | 11/1991 | Dingess | 123/48 R |
| 6,199,520 | B1 | * | 3/2001 | Warren | 123/48 R |
| 6,427,643 | B1 | * | 8/2002 | Dixon | 123/48 A |
| 7,100,567 | B1 | * | 9/2006 | Bailey et al. | 123/268 |

* cited by examiner

*Primary Examiner*—Stephen K. Cronin
*Assistant Examiner*—Jason Benton

(57) ABSTRACT

In conventional engines, the compression ratio is a constant. Therefore, cylinder pressure increases proportionately with intake manifold pressure. As manifold pressure changes dramatically according to load, a conventional engine cannot maintain anywhere near constant (let alone optimum) cylinder pressure. Below optimum cylinder pressure, the engine is inefficient—above optimum, it suffers undue stress and (depending on fuel) may emit excess nitrous oxides. My invention makes it possible to manipulate the combustion chamber volume, and therefore the compression ratio, while the engine is running. By changing the compression ratio in a manner inversely proportional to changes in manifold pressure, we can maintain a constantly optimized cylinder pressure.

3 Claims, 4 Drawing Sheets

1 / 4
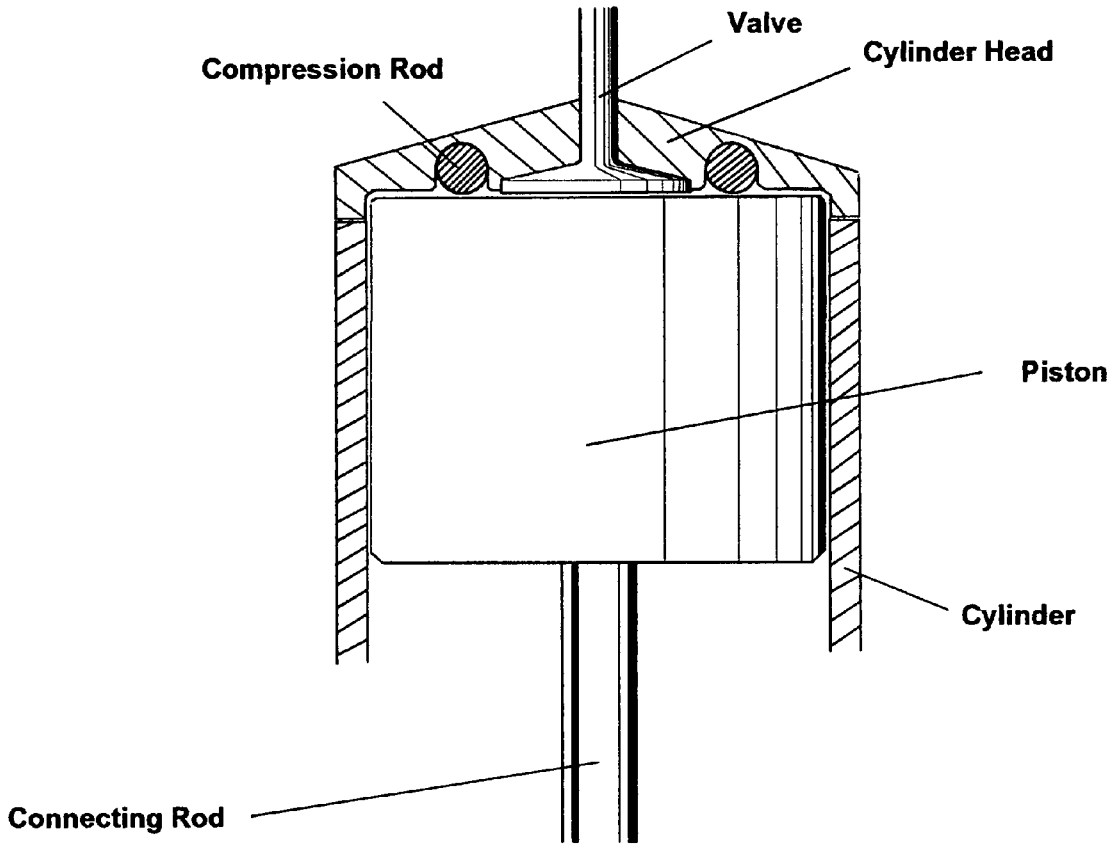
Illustration #1: Side View
Note: Cylinder head simplified, not showing intake/exhaust ports. Second valve not visible because it is directly behind the first.

2/4
Note:
In this example, opposing rods to balance force on piston.
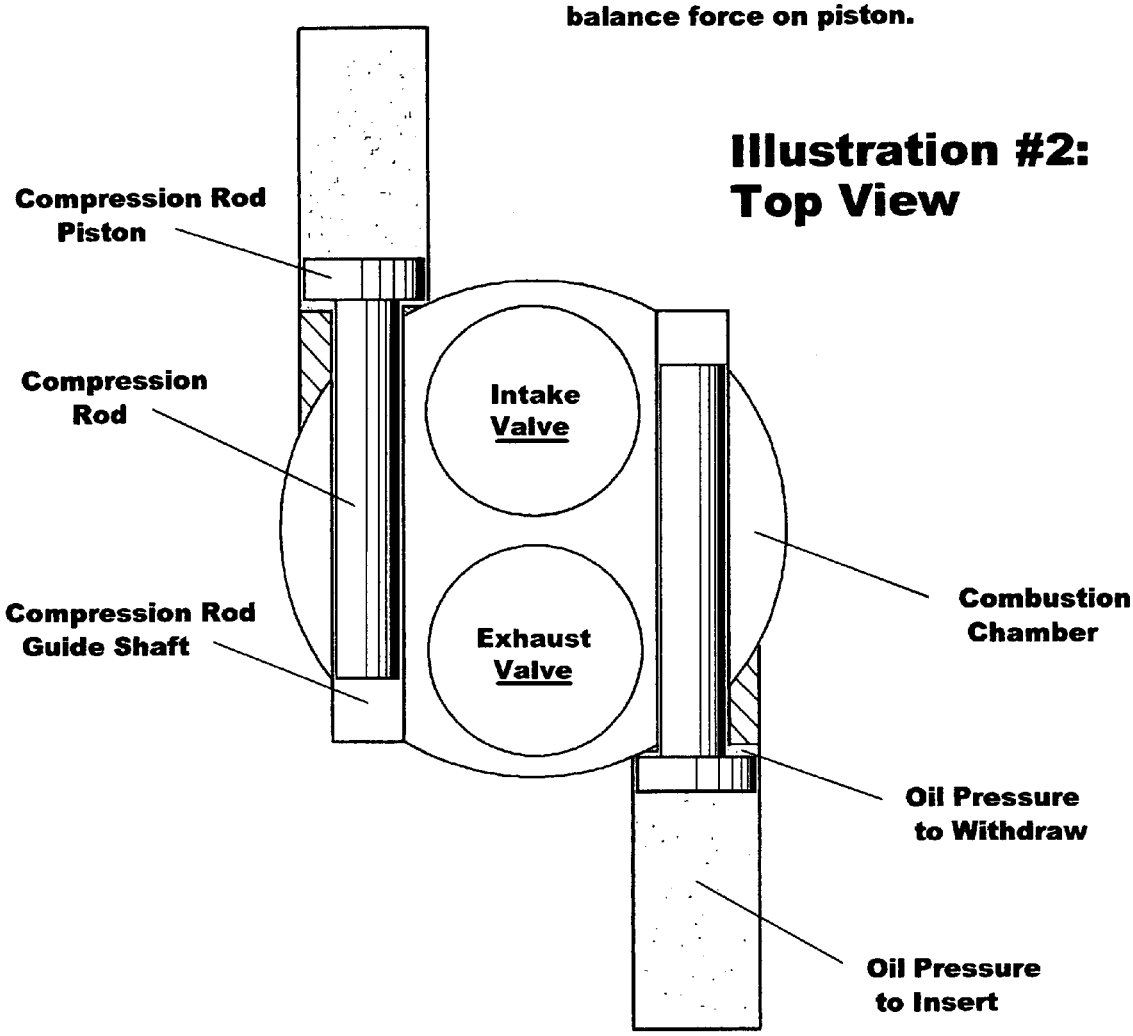
Note:
For illustration purposes only. Not to scale, and not showing details such as the closed portion of the compression rod guides "Original"
3 / 4

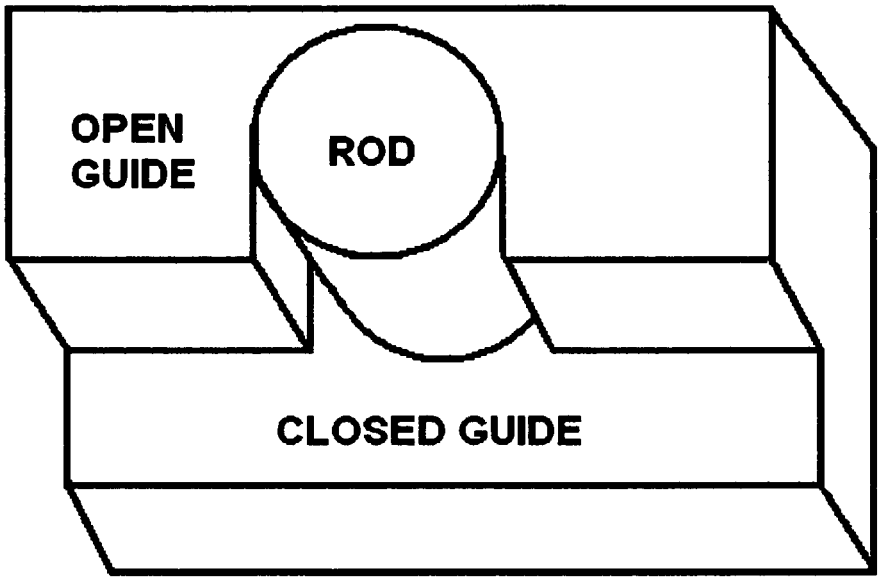

Crude illustration of what is meant by "open" or "closed" portions of the compression rod guide. The portion of the guide inside the combustion chamber is open in order to effect chamber volume. The portion of the guide between the combustion chamber and the compression rod piston cylinder is closed so as to more precisely guide the rod. This closed portion is also where the rod is sealed and lubricated.

4 / 4
Universality of the Device:
Another permutation applied to an engine with four valves per cylinder and direct fuel injection
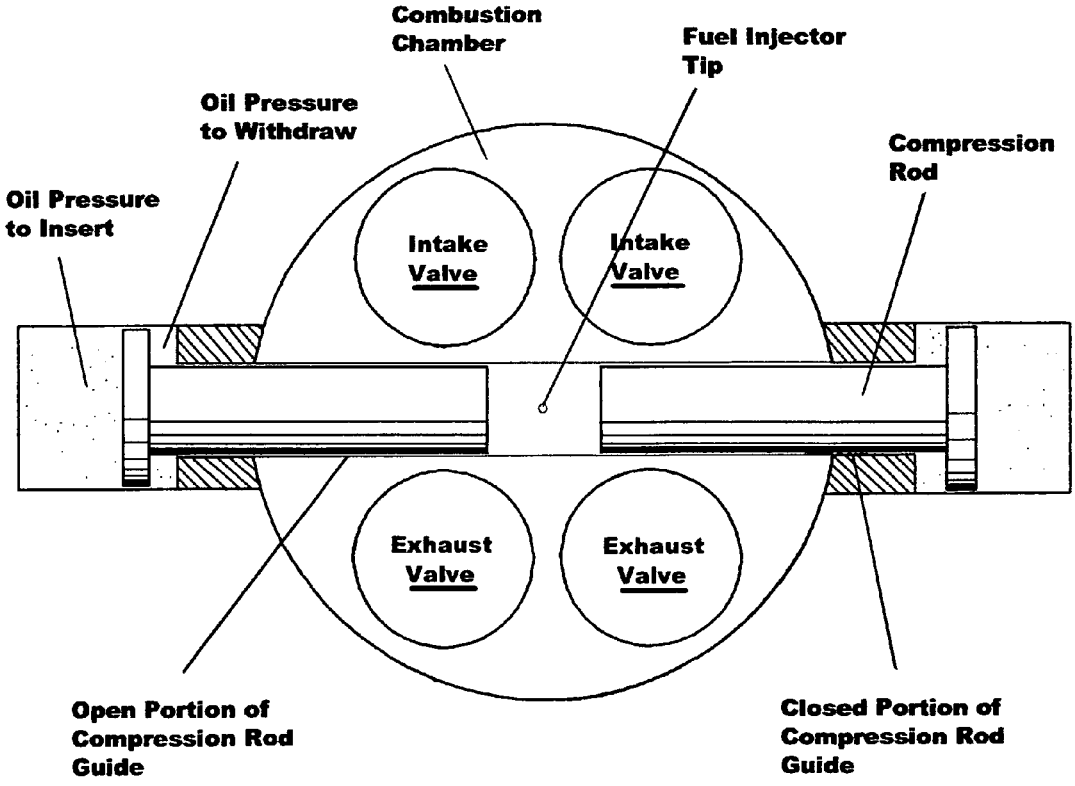
Illustration #4:
(Top View)

CONSTANT OPTIMUM TOTAL COMPRESSION: REAL-TIME MANIPULATION OF COMBUSTION CHAMBER VOLUME AS A MEANS OF OPTIMIZING COMPRESSION IN INTERNAL COMBUSTION ENGINES

CROSS-REFERENCE TO RELATED APPLICATIONS

This application claims the benefit of provisional Patent Application No. 60/632,878 filed on Dec. 3, 2004

STATEMENT REGARDING FEDERALLY SPONSORED RESEARCH OR DEVELOPMENT—NOT APPLICABLE

REFERENCE TO SEQUENCE LISTING, A TABLE, OR A COMPUTER PROGRAM LISTING COMPACT DISC APPENDIX—NOT APPLICABLE

BACKGROUND OF THE INVENTION

This invention pertains to internal combustion engines. It is specific to piston engines, although it may have application to other engines. Over the last several decades, virtually all engine systems have been refined significantly through the use of onboard computers. Ignition timing (injector timing in the case of diesel), fuel delivery, air/fuel ratio, manifold pressure, throttle position, coolant temperature—all these and more are monitored and manipulated in real time by the onboard computer. One engine system remains stone-age simple: compression.

Conventional engines are designed with a set compression ratio, while all other engine systems are made to cater to changing conditions. This is an inherent flaw. Actual cylinder pressure (peak pressure just prior to combustion) fluctuates wildly in proportion to wildly fluctuating intake manifold pressure, because the compression ratio simply multiplies the existing intake pressure.

BRIEF SUMMARY OF THE INVENTION

The purpose of the invention is to manipulate the compression ratio in a manner inversely proportional to changes in intake manifold pressure, thus enabling a constant cylinder pressure. This constant cylinder pressure can then be optimized as every other engine system is optimized, in real time. This manipulation of compression ratio will be accomplished by controlling the volume of the combustion chamber. Details of this are explained in the "detailed description of the invention" section.

BRIEF DESCRIPTION OF THE SEVERAL VIEWS OF THE DRAWING

Drawing 1/4 is a side view of how two compression rods can be recessed into the top of a two-valve-per-cylinder combustion chamber.

Drawing 2/4 is a top view of the same application, showing the rods' position relative to the valves and how the rods could be moved by pistons on their ends, utilizing engine oil pressure.

Drawing 3/4 illustrates in a crude but specific way what is meant by "open" vs. "closed" portions of the compression rod guides.

Drawing 4/4 is a top view showing that the device is adaptable to any type of combustion chamber. In this drawing, it is a four-valve-per-cylinder application with direct fuel injection. This drawing also elaborates on the concept of compression rod pistons and "open" vs. "closed" portions of the compression rod guides.

I drew all the pictures except #3 on the computer in color so as to distinguish the different parts, and sent them (all but #4) with my provisional patent application. Subsequently, I found that you do not normally accept color drawings. Therefore, I had my computer generate them in black and white. I am sending the black and white because they meet the specifications, but believe the color is superior because it more clearly discriminates the parts and illustrates (for example) the oil surrounding the compression rod pistons. If you feel that color may be acceptable in this case, I will be glad to pay the petition fee and send you the three copies of color prints. Thank you for your consideration.

DETAILED DESCRIPTION OF THE INVENTION

I hope this does not violate the protocol. I know that theories and laws of nature are not patentable, but believe that the theory behind this invention is crucial in understanding why it is necessary and how it works. The following two pages explain all this as well as details of design and function in a concise and logical way. They are drawn verbatum from my provisional patent application.

CONSTANT OPTIMUM TOTAL COMPRESSION

1. Definition of Terms

"engine" refers to internal combustion engines, specifically piston engines, although some aspects of the discussion may also apply to other engines.

"nominal compression" refers to the natural internal compression ratio of the piston engine, such as "eight-to-one", which will be here designated as "8/1".

"manifold pressure" refers to the real-time air pressure in the intake manifold of the engine.

"total compression" is defined as the product of nominal compression and manifold pressure. It may be expressed as either a simple pressure (example: 8/1 times 7.5 PSI equals 60 PSI) or as a ratio (example: 8/1 times one-half atmosphere of pressure equals 4/1 or 4TC). I prefer the latter expression because it is independent of arbitrary measurements such as lbs., kg, meters or inches, and because I believe it more simply describes both the problem and the solution.

2. The Thesis

For every engine, under every load condition, there exists an optimum total compression. Below this optimum total compression, the engine loses efficiency; above it, the engine suffers undue stress and may emit excess nitrous oxides. The optimum total compression for a specific engine is contingent on the type and quality of fuel being used as well as the ambient air temperature at the time and place of operation.

3. The Problem

All conventional engines treat nominal compression as a constant, so that total compression is entirely dependent on manifold pressure. Since manifold pressure increases dramatically under load, total compression increases likewise.

As a result, engines are designed with inadequate total compression under light and even moderate loads in order to avoid dangerous and toxic overcompression under heavy loads. All other engine systems (ignition timing, fuel delivery, turbochargers, etc.) are required to operate at less than optimum performance to either augment undercompression or offset overcompression. Whole engine systems (such as EGR) are designed with the sole purpose of compensating for the faults of the compression system.

4. The Solution

By manipulating the nominal compression in a manner inversely proportional to changes in manifold pressure, we can maintain constant optimum total compression. For example, if our target TC for a particular fuel in a particular engine is 8TC, then at a manifold pressure of one-half atmosphere we must manipulate the nominal compression to 16/1. If our turbocharger boosts the manifold pressure to two atmospheres, we now lower the nominal compression to 4/1. The total compression remains constant at 8TC. In this example, the nominal compression was quartered as the manifold pressure quadrupled. If we can do this in real time, then other engine systems can be optimized independent of compression, and systems such as EGR can be eliminated entirely. Pistons (especially in diesel) can be made lighter, allowing greater RPM range. Whole engines can be made lighter, smaller, etc. They will be more efficient and more durable. Turbochargers may have quicker response at low end (due to hotter exhaust from increased compression) and produce less back-pressure at high end (due to cooler exhaust from reduced compression). We must, however, find a way to manipulate the nominal compression without overcomplicating the engine or harming its structural integrity.

One way of doing this is by the insertion of one or more slender cylindrical rods* into the combustion chamber parallel with the approximate plane of the face of the combustion chamber and perpendicular to the stroke of the piston. The shape of both piston face and combustion chamber could be changed to accommodate the rod(s), with the side(s) of the rod(s) opposite the piston resting against the machined face of the combustion chamber.

*The compression rods should be slender both for the precision of volumetric adjustment and for the reduced force required to hold position under pressure. They should be cylindrical for ease and precision of machining and sealing.

Each rod could have an oversize piston at one end utilizing engine oil pressure to insert or withdraw the rod as directed by the onboard computer. Some of this oil would be allowed to travel down the rod as lubrication, with the rods being sealed by rings similar to those on pistons. There would be one or more drain hole(s) in the rod guide shafts to vent excess oil and blow-by.

Many small details would have to be worked out, but in the end the engine would in some respects be simpler. It would certainly be better. A single engine could be programmed to accommodate different fuels as those were available. Every fuel will have a different optimum total compression.

5. The Drawings Follow.

I claim:

1. A system of variable compression ratio for internal combustion engines with a single combustion chamber per cylinder, comprising:

(a) one or more cylindrical compression rods imbedded in the face of the combustion chamber, parallel with the approximate plane of the face of the combustion chamber and perpendicular to the travel of the piston, with one end of said one or more cylindrical compression rods extending out of the combustion chamber, and (b) the means to insert/withdraw said compression rod or rods into/from the combustion chamber on demand, thereby altering the volume of the combustion chamber.

2. The system as defined in claim #1 wherein said compression rods travel in guides that are semi-cylindrical in shape in the face of the combustion chamber, leaving each rod exposed on the side facing the piston, and cylindrical in shape where the rod exits the combustion chamber as shown in illustration #4.

3. The system as defined in claim #1 wherein the exterior end of each compression rod is attached directly to a larger piston utilizing engine oil pressure to insert/withdraw the rod at the discretion of an onboard computer.

* * * * *